US009423714B2

(12) United States Patent
Kenmoku et al.

(10) Patent No.: US 9,423,714 B2
(45) Date of Patent: Aug. 23, 2016

(54) TONER

(71) Applicant: CANON KABUSHIKI KAISHA, Tokyo (JP)

(72) Inventors: Takashi Kenmoku, Mishima (JP); Shintaro Kawaguchi, Yokohama (JP); Naotaka Ikeda, Suntou-gun (JP); Yasuhiro Hashimoto, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 14 days.

(21) Appl. No.: 14/625,502

(22) Filed: Feb. 18, 2015

(65) Prior Publication Data

US 2015/0241806 A1 Aug. 27, 2015

(30) Foreign Application Priority Data

Feb. 24, 2014 (JP) ..... 2014-032784

(51) Int. Cl.

| | |
|---|---|
| ***G03G 9/097*** | (2006.01) |
| ***G03G 9/08*** | (2006.01) |
| ***G03G 9/087*** | (2006.01) |

(52) U.S. Cl.

CPC ..... *G03G 9/09775* (2013.01); *G03G 9/0806* (2013.01); *G03G 9/08706* (2013.01); *G03G 9/08726* (2013.01); *G03G 9/08791* (2013.01); *G03G 9/08795* (2013.01); *G03G 9/08797* (2013.01)

(58) Field of Classification Search

CPC ..... G03G 9/08795; G03G 9/097

See application file for complete search history.

(56) References Cited

U.S. PATENT DOCUMENTS

| | | | | |
|---|---|---|---|---|
| 4,797,339 | A | 1/1989 | Maruyama et al. | |
| 4,996,127 | A | 2/1991 | Hasegawa et al. | |
| 6,342,328 | B1 | 1/2002 | Takasaki et al. | |
| 7,459,253 | B2 | 12/2008 | Abe et al. | |
| 7,704,661 | B2 | 4/2010 | Ikeda et al. | |
| 8,053,156 | B2 | 11/2011 | Abe et al. | |
| 8,247,147 | B2 | 8/2012 | Abe et al. | |
| 8,367,289 | B2 | 2/2013 | Isono et al. | |
| 8,652,725 | B2 | 2/2014 | Watanabe et al. | |
| 8,828,633 | B2 | 9/2014 | Itabashi et al. | |
| 8,916,319 | B2 | 12/2014 | Ikeda et al. | |
| 2002/0067399 | A1* | 6/2002 | Yabuki ..... | C09D 11/328 347/100 |

FOREIGN PATENT DOCUMENTS

| | | | |
|---|---|---|---|
| JP | 36-10231 | B2 | 7/1961 |
| JP | 59-53856 | A | 3/1984 |
| JP | 59-61842 | A | 4/1984 |
| JP | 62-106473 | A | 5/1987 |
| JP | 63-186253 | A | 8/1988 |
| JP | 2807795 | B2 | 10/1998 |
| JP | 11-327208 | A | 11/1999 |

OTHER PUBLICATIONS

U.S. Appl. No. 14/630,636, filed Feb. 24, 2015. Inventor: Katsuta, et al.

U.S. Appl. No. 14/630,635, filed Feb. 24, 2015. Inventor: Katsura, et al.

* cited by examiner

*Primary Examiner* — Hoa V Le

(74) *Attorney, Agent, or Firm* — Fitzpatrick, Cella, Harper & Scinto

(57) ABSTRACT

A toner has a toner particle that contains a binder resin and a charge control resin, wherein the charge control resin is a polymer that contains a unit A and a unit B, the unit A is a unit derived from 2-acrylamido-2-methylpropanesulfonic acid, the unit B is a unit derived from an electron donor compound that has a polymerizable unsaturated group, and a molar ratio between the unit A and the unit B is from 1.0 to 10.0.

4 Claims, 2 Drawing Sheets

TONER

BACKGROUND OF THE INVENTION

1. Field of the Invention

The present invention relates to a toner for forming a toner image in image-forming methods such as electrophotography and electrostatic printing or in toner jet-based image-forming methods.

2. Description of the Related Art

Investigations in pursuit of improvements in the tribo-charging characteristics of toners are being actively carried out. In particular, the use of a resin having a charge control function (a charge control resin) as a toner starting material has been proposed in recent years based on considerations such as environmental concerns, demands for a more stable charging performance, production costs, and so forth. For example, toner in which a resin containing sulfonic acid is used as the charge control resin has been proposed (Japanese Patent Application Laid-open No. H11-327208 and Japanese Patent No. 2,807,795). According to this proposal, it is possible to obtain toner having stable charging characteristics with little variation in the charge amount due to the environmental variations.

SUMMARY OF THE INVENTION

However, when the present inventors carried out intensive investigations into the aforementioned proposals, it became clear that with reference to the output of a large number of prints there was room for improvement in the charge stability and in particular in the stability of the quantity of charge at high temperatures and high humidities.

The present invention was achieved in view of this problem. That is, an object of the present invention is to provide a toner that, during the output of a large number of prints, exhibits an excellent charge stability and in particular exhibits an excellent stability in the quantity of charge at high temperatures and high humidities.

As a result of intensive investigations, the present inventors discovered that the problem indicated above is solved by the toner of the present invention and achieved the present invention based on this discovery.

That is, the present invention is a toner having a toner particle that contains a binder resin and a charge control resin, wherein the charge control resin is a polymer that contains a unit A and a unit B, the unit A is a unit derived from 2-acrylamido-2-methylpropanesulfonic acid, the unit B is a unit derived from an electron donor compound that has a polymerizable unsaturated group, and a molar ratio between the unit A and the unit B in the charge control resin (mol % of unit A/mol % of unit B) is from 1.0 to 10.0.

The present invention can provide a toner that, during the output of a large number of prints, exhibits an excellent charge stability and in particular exhibits an excellent stability in the quantity of charge at high temperatures and high humidities.

Further features of the present invention will become apparent from the following description of exemplary embodiments (with reference to the attached drawings).

DESCRIPTION OF THE EMBODIMENTS

Figure 1:
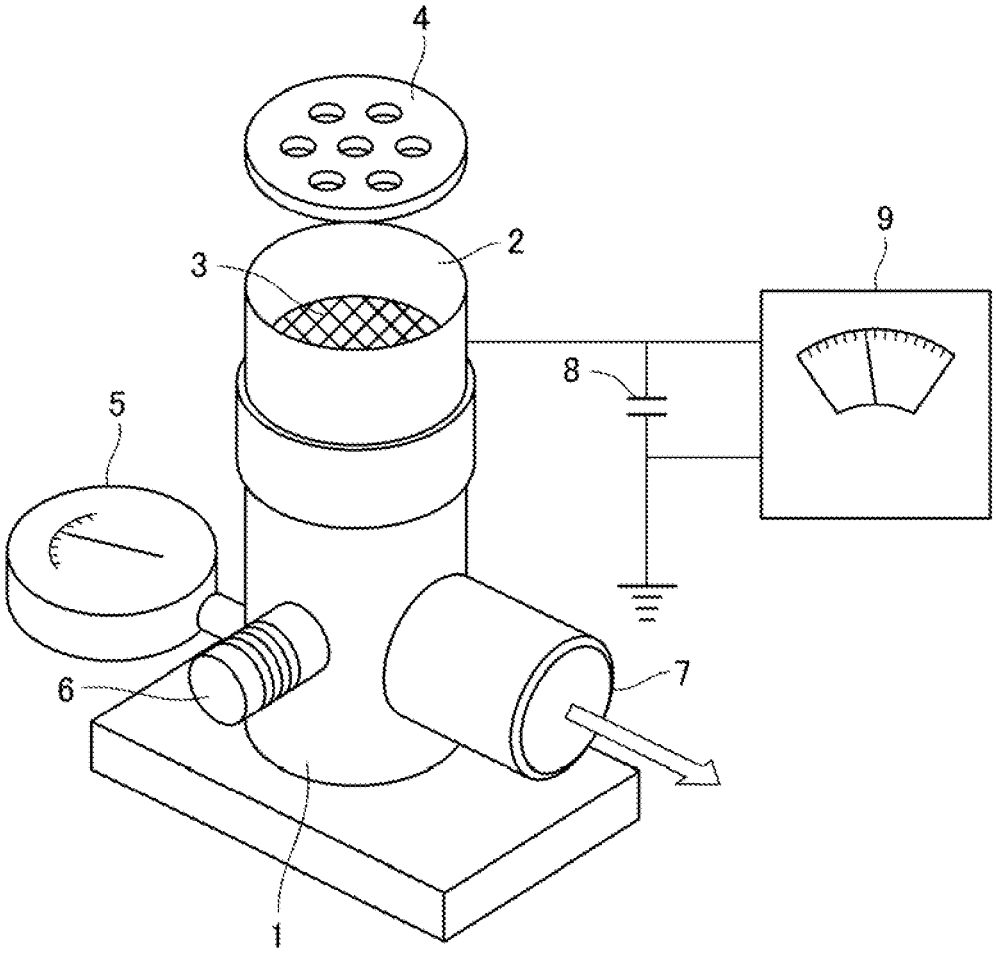
FIG. 1 is a diagram that shows the structure of an apparatus used to measure the triboelectric charge quantity of developer that uses the toner of the present invention.

The present inventors discovered that a toner having a toner particle that contains a binder resin and a charge control resin, wherein the charge control resin is a polymer that contains a unit A and a unit B, the unit A is a unit derived from 2-acrylamido-2-methylpropanesulfonic acid, the unit B is a unit derived from an electron donor compound that has a polymerizable unsaturated group, and a molar ratio between the unit A and the unit B in the charge control resin (mol % of unit A/mol % of unit B) is from 1.0 to 10.0, can provide a toner that, during the output of a large number of prints, exhibits an excellent charge stability and in particular exhibits an excellent stability in the quantity of charge at high temperatures and high humidities. The present invention was achieved based on this discovery.

The mechanism by which the adoption of the structure of the present invention provides a toner that exhibits an excellent stability in the quantity of charge at high temperatures and high humidities is unclear, but the present inventors hold as follows.

The unit deriving from 2-acrylamido-2-methylpropanesulfonic acid in the polymer constituting the charge control resin does exhibit an excellent charge production and an excellent charge accumulation, but also readily undergoes hydration because it has the sulfonic acid moiety. Since charge production and accumulation are inhibited by hydration in particular at a high temperature/high humidity, differences are then readily produced in the quantity of charge between normal temperatures/normal humidities and high temperatures/high humidities.

On the other hand, an ion complex is produced by the presence in the polymer of both the unit deriving from 2-acrylamido-2-methylpropanesulfonic acid and the unit deriving from an electron donor compound that has a polymerizable unsaturated group. It is thought that the presence of the polymer as an ion complex serves to impede water absorption more than for the presence of the 2-acrylamido-2-methylpropanesulfonic acid-derived unit as the sulfonic acid. It is thought in particular that a toner having an excellent stability in the quantity of charge at high temperatures and high humidities is obtained due to the inhibition of water absorption at high temperatures/high humidities.

In addition, it is an essential feature that the molar ratio in this charge control resin between the 2-acrylamido-2-methylpropanesulfonic acid-derived unit (unit A) and the unit derived from an electron donor compound having a polymerizable unsaturated group (unit B) (mol % in the charge control resin of the 2-acrylamido-2-methylpropanesulfonic acid-derived unit (unit A)/mol % in the charge control resin of the unit derived from an electron donor compound having a polymerizable unsaturated group (unit B)) be from 1.0 to 10.0.

When this ratio is less than 1.0, the unit derived from an electron donor compound having a polymerizable unsaturated group becomes excessive relative to the 2-acrylamido-2-methylpropanesulfonic acid-derived unit and charge production and accumulation are then impaired.

When this ratio is larger than 10.0, only a small amount is present as the ion complex and as a consequence hydration readily occurs at high temperatures/high humidities and the quantity of charge then declines at high temperatures/high humidities.

This ratio is more preferably from 1.3 to 3.0.

The charge control resin in the toner of the present invention is constituted of a polymer that contains a unit derived from 2-acrylamido-2-methylpropanesulfonic acid and a unit derived from an electron donor compound that has a polymerizable unsaturated group. The content in this charge control resin of the 2-acrylamido-2-methylpropanesulfonic acid-derived unit is preferably from 0.2 mol % to 10.0 mol % and is more preferably from 1.0 mol % to 5.0 mol %.

The polymerizable unsaturated group-bearing electron donor compounds usable in the present invention may be any polymerizable unsaturated group-bearing electron donor compound that has an unshared electron pair, but are not otherwise particularly limited. The moiety having an electron-donating capability preferably has at least one skeleton selected from primary to tertiary amines, imines, primary to tertiary amides, imides, aromatic imides (e.g., pyridine), thiols, thioesters, thionyls, sulfides, and sulfoxides. The polymerizable unsaturated group preferably has, for example, the vinyl group, acryloyl group, or methacryloyl group.

The following are preferred among the preceding for polymerizable unsaturated group-bearing electron donor compounds usable in the present invention: vinylpyridines such as 4-vinylpyridine and 2-vinylpyridine, and derivatives thereof; N-vinylpyrrolidones such as N-vinyl-2-pyrrolidone, and derivatives thereof; and acryloylmorpholines such as 4-acryloylmorpholine, and derivatives thereof; among which vinylpyridines are more preferred.

The polymer for the charge control resin according to the present invention preferably has a polymerizable monomer-derived unit that forms the main chain structure. There are no particular limitations on this main chain structure. Examples here are vinylic polymers, polyester-type polymers, polyamide-type polymers, polyurethane-type polymers, and polyether-type polymers. In a preferred aspect, the charge control resin according to the present invention has the 2-acrylamido-2-methylpropanesulfonic acid-derived unit and the unit derived from a polymerizable unsaturated group-bearing electron donor compound in the main chain of such a polymer. Viewed from the standpoint of the production of this charge control resin, the main chain structure is preferably a vinylic polymer based on considerations of the ease of production and cost advantages.

The main chain of the charge control resin may be a vinylic copolymer. There are no particular limitations on the vinylic monomer that can be used for the vinylic polymer or copolymer, and the vinylic monomer can be specifically exemplified by the following compounds: styrenes such as styrene, o-methylstyrene, m-methylstyrene, p-methylstyrene, and α-methylstyrene, and derivatives thereof; ethylenically unsaturated monoolefins such as ethylene, propylene, butylene, and isobutylene; vinyl halides such as vinyl chloride, vinylidene chloride, vinyl bromide, and vinyl fluoride; the vinyl esters of acids, such as vinyl acetate, vinyl propionate, and vinyl benzoate; acrylate esters such as n-butyl acrylate and 2-ethylhexyl acrylate; the methacrylate esters provided by changing the acrylate in the acrylate esters to methacrylate; amino esters of methacrylic acid, such as dimethylaminoethyl methacrylate and diethylaminoethyl methacrylate; vinyl ethers such as vinyl methyl ether and vinyl ethyl ether; vinyl ketones such as vinyl methyl ketone; as well as acrylic acid and methacrylic acid.

There are no particular limitations on the method of producing the charge control resin according to the present invention. It can be obtained, for example, by polymerizing 2-acrylamido-2-methylpropanesulfonic acid and a polymerizable unsaturated group-bearing electron donor compound along with the previously referenced polymerizable monomer that forms the main chain structure.

Various polymerization initiators, e.g., peroxide-type polymerization initiators, azo-type polymerization initiators, and so forth, can be used to produce the charge control resin according to the present invention. Usable peroxide-type polymerization initiators can be exemplified by organic types such as peroxy esters, peroxy dicarbonates, dialkyl peroxides, peroxy ketals, ketone peroxides, hydroperoxides, and diacyl peroxides. The inorganic types can be exemplified by persulfates and hydrogen peroxide. Specific examples are peroxy esters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butylperoxy isopropyl monocarbonate, and t-butylperoxy 2-ethylhexyl monocarbonate; diacyl peroxides such as benzoyl peroxide; peroxydicarbonates such as diisopropyl peroxydicarbonate; peroxy ketals such as 1,1-di-t-hexylperoxy cyclohexane; dialkyl peroxides such as di-t-butyl peroxide; as well as t-butylperoxy allyl monocarbonate. Usable azo-type polymerization initiators can be exemplified by 2,2'-azobis(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, azobisisobutyronitrile, and dimethyl 2,2'-azobis(2-methylpropionate).

As necessary two or more of these polymerization initiators may also be used at the same time. The use amount of the polymerization initiator used here is preferably from 0.1 mass parts to 20.0 mass parts per 100 mass parts of the polymerizable monomer. Any of the following methods may be used for the polymerization method, but there is no particular limitation thereon: solution polymerization, suspension polymerization, emulsion polymerization, dispersion polymerization, precipitation polymerization, and bulk polymerization.

With regard to the method for controlling the molar ratio in the charge control resin in the toner of the present invention between the 2-acrylamido-2-methylpropanesulfonic acid-derived unit (unit A) and the unit derived from an electron donor compound having a polymerizable unsaturated group (unit B) (mol % of the 2-acrylamido-2-methylpropanesulfonic acid-derived unit/mol % of the unit derived from an electron donor compound having a polymerizable unsaturated group) to from 1.0 to 10.0, polymerization may be carried out using the methods indicated above while controlling the charged amounts.

With regard to the molecular weight of the charge control resin in the toner of the present invention, the weight-average molecular weight (Mw) as determined by gel permeation chromatography (GPC) is preferably from 2,500 to 100,000 and is more preferably from 15,000 to 60,000. When the weight-average molecular weight is less than 2,500, intramolecular skew by the 2-acrylamido-2-methylpropanesulfonic acid-derived unit and the polymerizable unsaturated group-bearing electron donor compound-derived unit in the polymer tends to be readily produced. This results in the appearance of a declining trend for the quantity of charge at high temperatures/high humidities. In addition, when the weight-average molecular weight exceeds 100,000, the dispersity of the charge control resin in the toner readily declines and a trend of a declining charge stability appears.

Known methods can be used as the method for adjusting the weight-average molecular weight of the charge control resin in the toner of the present invention.

A narrow molecular weight distribution is preferred for the charge control resin from the standpoint of the charging characteristics and the fixing performance. The ratio (Mw/Mn) between the weight-average molecular weight Mw and the number-average molecular weight Mn as determined by gel permeation chromatography is preferably from 1.0 to 6.0. From 1.0 to 4.0 is more preferred.

The content of the charge control resin in the toner of the present invention is not particularly limited, but is preferably from 0.05 mass parts to 20.0 mass parts per 100 mass parts of the binder resin. A content in the indicated range provides an excellent dispersity in the toner particle and thus supports a thorough elaboration of the effects from addition.

The binder resin used in the toner of the present invention is not particularly limited. The binder resin can be formed by the polymerization of a polymerizable monomer in toner particle production by a suspension polymerization method. There are no particular limitations on the polymerizable monomer in this case, and the previously described vinylic monomers are favorably used. Moreover, in addition to the polymerizable monomer in the monomer composition here, the material constituting the binder resin can also be provided by the further addition of a vinylic resin or a polyester resin.

Vinylic resins usable for the binder resin in the toner of the present invention can be exemplified by the following: styrenic resins, acrylic resins, methacrylic resins, styrene-acrylic resins, styrene-methacrylic resins, polyethylene resins, polyethylene-vinyl acetate resins, vinyl acetate resins, and polybutadiene resins.

The polyester resin can be a polyester resin as commonly produced using a polyhydric alcohol and a carboxylic acid or carboxylic acid anhydride or carboxylic acid ester as starting monomers. In specific terms, polyester resins provided by the condensation polymerization of the following components are preferred: a bisphenol derivative for the diol component; for the acid component, a carboxylic acid component composed of an at least dibasic carboxylic acid or anhydride thereof, or fumaric acid, maleic acid, maleic anhydride, phthalic acid, terephthalic acid, trimellitic acid, or pyromellitic acid, or a lower alkyl ester thereof.

Aside from vinylic resins and polyester resins, phenolic resins, polyurethane resins, polybutyral resins, and hybrid resins provided by the bonding of these resins in any regime may also be used.

Among the preceding, the following are preferably used from the standpoint of the toner properties: styrenic resins, acrylic resins, methacrylic resins, styrene-acrylic resins, styrene-methacrylic resins, polyester resins, and hybrid resins provided by the bonding of a polyester resin with a styrene-acrylic resin or a styrene-methacrylic resin.

The toner of the present invention may contain a release agent. This release agent can be exemplified by aliphatic hydrocarbon waxes such as low molecular weight polyethylene, low molecular weight polypropylene, microcrystalline wax, and paraffin wax; the oxides of aliphatic hydrocarbon waxes, such as oxidized polyethylene wax; the block copolymers of aliphatic hydrocarbon waxes; waxes in which the major component is a fatty acid ester, such as carnauba wax, sasol wax, and montanic acid ester waxes; waxes provided by the partial or complete deacidification of fatty acid esters, such as deacidified carnauba wax; partial esters between fatty acids and polyhydric alcohols, such as behenyl monoglyceride; and hydroxyl group-bearing methyl ester compounds obtained by the hydrogenation of vegetable oils and fats.

With regard to the molecular weight distribution of the release agent, the main peak is preferably in the molecular weight region from 400 to 2,400 and is more preferably in the region from 430 to 2,000. This makes it possible to impart preferred thermal properties to the toner. The amount of addition of the release agent, expressed as the total amount per 100 mass parts of the binder resin, is preferably from 2.5 mass parts to 40.0 mass parts and is more preferably from 3.0 mass parts to 15.0 mass parts.

The colorants usable in the toner of the present invention can be exemplified by known colorants, for example, the various heretofore known dyes and pigments.

The colored pigments for magenta can be exemplified by C. I. Pigment Red 3, 5, 17, 22, 23, 38, 41, 112, 122, 123, 146, 149, 178, 179, 190, and 202 and by C. I. Pigment Violet 19 and 23. These pigments may be used by themselves, or a dye and pigment combination may be used.

The colored pigments for cyan can be exemplified by C. I. Pigment Blue 15, 15:1, and 15:3 and by copper phthalocyanine pigments in which from 1 to 5 phthalimidomethyl groups are substituted on the phthalocyanine skeleton.

The colored pigments for yellow can be exemplified by C. I. Pigment Yellow 1, 3, 12, 13, 14, 17, 55, 74, 83, 93, 94, 95, 97, 98, 109, 110, 154, 155, 166, 180, and 185.

The following can be used for the black colorant: carbon black, aniline black, acetylene black, titanium black, and black colorants as provided by color mixing the previously indicated yellow/magenta/cyan colorants to give a black color.

The colorant is preferably used by the addition of from 1 mass parts to 20 mass parts per 100 mass parts of the binder resin.

The toner of the present invention may also be used in the form of a magnetic toner, in which case a magnetic body as exemplified by the following is used: iron oxides such as magnetite, maghemite, and ferrite, and iron oxides that contain another metal oxide; metals such as Fe, Co, and Ni, as well as alloys of these metals with a metal such as Al, Co, Cu, Pb, Mg, Ni, Sn, Zn, Sb, Ca, Mn, Se, or Ti, and mixtures of the preceding; and iron(II,III) oxide ($Fe_3O_4$), ferric oxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$). A single one of these magnetic materials may be used or a combination of two or more may be used. A finely divided powder of iron(II,III) oxide or $\gamma$-ferric oxide is a particularly favorable magnetic material.

These magnetic bodies preferably have an average particle diameter of from 0.1 μm to 1.0 μm and more preferably of from 0.1 μm to 0.3 μm. In addition, the magnetic properties for the application of 795.8 kA/m (10K oersted) are as follows: a coercive force (Hc) generally of from 1.6 kA/m to 12 kA/m (from 20 oersted to 150 oersted), and a saturation magnetization ($\sigma s$) generally of from 5 $Am^2/kg$ to 200 $Am^2/kg$ and preferably of from 50 $Am^2/kg$ to 100 $Am^2/kg$. The residual magnetization ($\sigma r$) is preferably from 2 $Am^2/kg$ to 20 $Am^2/kg$.

The magnetic body is used, expressed per 100 mass parts of the binder resin, generally at from 10 mass parts to 200 mass parts and preferably at from 20 mass parts to 150 mass parts.

The method of producing the toner is not particularly limited and known production methods may be used. Specific examples are as follows:

(A) methods in which the toner particle is directly produced using a suspension polymerization method as described in Japanese Examined Publication No. S36-10231 and Japanese Patent Application Laid-open Nos. S59-53856 and S59-61842;

(B) methods in which the toner particle is produced by an interfacial polymerization method, such as a microcapsule production method;

(C) methods in which the toner particle is produced by a coacervation method;

(D) methods in which the toner particle is obtained by an aggregation method in which a toner particle having a desired particle diameter is obtained by the aggregation of at least one type of finely divided particle, as disclosed in Japanese Patent Application Laid-open Nos. S62-106473 and S63-186253;

(E) methods in which the toner particle is produced by a dispersion polymerization method characterized by monodispersity;

(F) polymer dissolution (melting) suspension methods in which the required resins are dissolved in a non-water-soluble organic solvent followed by toner particulation in water;

(G) methods in which the toner particle is obtained by an emulsion-dispersion method;

(H) pulverization methods in which the toner components are kneaded and dispersed to uniformity using, for example, a pressure kneader, extruder, or media-based dispersing apparatus, followed by cooling and fine pulverization of the kneadate to the desired toner particle diameter either mechanically or by impact on a target in a jet current, and further sharpening of the particle size distribution through a classification step; and (I) methods in which the toner particle is obtained by the spheronization processing—by, for example, heating in a solvent—of a toner particle that has been obtained by a pulverization method.

Among the preceding, the effects of the present invention are more substantially manifested in particular when the toner particle is produced by a suspension polymerization method. The reason for this is that the charge control resin can be effectively localized to the neighborhood of the toner particle surface in the step of granulation in an aqueous medium (the granulating step).

That is, the toner particle is preferably obtained by a method containing steps of a dispersing step for dispersing the polymerizable monomer composition containing the polymerizable monomer and charge control resin in an aqueous medium, a granulating step for producing particles of the polymerizable monomer composition in the aqueous medium and a polymerizing step for polymerizing the polymerizable monomer present in these particles.

When the toner particle is produced by a suspension polymerization method, as necessary the colorant is first uniformly mixed with dissolution or dispersion, using, for example, a stirrer, in the polymerizable monomer that will form the binder resin. When in particular the colorant is a pigment, a pigment dispersion paste is preferably made by treatment with a disperser. This is uniformly dissolved or dispersed, using, for example, a stirrer, with the polymerizable monomer, charge control resin, and polymerization initiator and the wax and other optional additives to produce a polymerizable monomer composition. The thusly obtained polymerizable monomer composition is added to a dispersion medium (preferably an aqueous medium) that contains a dispersion stabilizer and, using a high-speed dispersing apparatus such as a high-speed stirrer or an ultrasonic disperser as the stirring apparatus, a microfine dispersion is brought about until the toner particle diameter is reached (the granulating step). The toner particle can then be obtained by inducing the polymerization reaction, by exposure to light or heat, of the polymerizable monomer present in the polymerizable monomer composition that has been microfinely dispersed in the granulating step (the polymerization step). The polymerization initiator may be added after the granulating step.

A known method can be used for the method of dispersing the pigment in the organic medium. For example, as necessary a resin and pigment dispersing agent may be dissolved in the organic medium and while stirring the pigment powder may then be gradually added and thoroughly mixed into the solvent. Moreover, the pigment may be made into a stable microfine dispersion, i.e., may be dispersed into a uniform fine particle form, by the application of a mechanical shear force using a disperser, e.g., a ball mill, paint shaker, dissolver, attritor, sand mill, or high-speed mill.

The vinylic monomer that can be used for the charge control resin can be similarly used as polymerizable monomer favorable for use in the suspension polymerization method.

The dispersion medium that can be used in this production method is determined by the solubility in the dispersion medium of the binder resin, organic medium, polymerizable monomer, charge control resin, and so forth, but an aqueous dispersion medium is preferred. Dispersion media that can be used as aqueous dispersion media can be exemplified by water; alcohols such as methyl alcohol, ethyl alcohol, denatured ethyl alcohol, isopropyl alcohol, n-butyl alcohol, isobutyl alcohol, tert-butyl alcohol, and sec-butyl alcohol; and ether alcohols such as methyl cellosolve, cellosolve, isopropyl cellosolve, butyl cellosolve, and diethylene glycol monobutyl ether; in addition to these, water-soluble dispersion media can be selected from ketones such as acetone, methyl ethyl ketone, and methyl isobutyl ketone; esters such as ethyl acetate; ethers such as ethyl ether; acetals such as methylal and diethyl acetal; and acids such as formic acid, acetic acid, and propionic acid. However, the dispersion medium is particularly preferably water or an alcohol. A mixture of two or more of these solvents may also be used. The concentration of the polymerizable monomer composition in the dispersion medium, expressed with reference to the dispersion medium, is preferably from 1 mass % to 80 mass % and is more preferably from 10 mass % to 65 mass %.

A known dispersion stabilizer can be used as the dispersion stabilizer that may be used when an aqueous dispersion medium is used. Specific examples of inorganic compounds are calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. With regard to organic compounds, for example, polyvinyl alcohol, gelatin, methyl cellulose, methyl hydroxypropyl cellulose, ethyl cellulose, the sodium salt of carboxymethyl cellulose, polyacrylic acid and its salts, or starch can be used dispersed in a water phase. The concentration of the dispersion stabilizer is preferably from 0.2 mass parts to 20.0 mass parts per 100 mass parts of the polymerizable monomer composition.

The same polymerization initiators that may be used in the production of the charge control resin may be used for the polymerization initiator used when the toner of the present invention is produced by a suspension polymerization method.

A known crosslinking agent may also be added to toner production by a suspension polymerization method. The preferred amount of addition is from 0 mass parts to 15.0 mass parts per 100 mass parts of the polymerizable monomer.

A flowability improver may be added as an external additive to the toner particle. This flowability improver can be exemplified by fluororesin powders such as vinylidene fluoride fine powders and polytetrafluoroethylene fine powders; silica fine powders such as silica fine powders provided by a wet production method and silica fine powders provided by a dry production method, as well as treated silica fine powders as provided by subjecting these silica fine powders to a surface treatment with a treatment agent such as a silane coupling agent, titanium coupling agent, or silicone oil; titanium oxide fine powders; as well as alumina fine powders, treated titanium oxide fine powders, and treated aluminum oxide fine powders. The flowability improver has a specific surface area, as measured by the BET method using nitrogen adsorption, preferably of at least 30 $m^2/g$ and more preferably of at least 50 $m^2/g$. Generally from 0.01 mass parts to 8.0 mass parts and preferably from 0.1 mass parts to 4.0 mass parts of the flowability improver is used per 100 mass parts of the toner particle.

The weight-average particle diameter (D4) of the toner is generally from 3.0 μm to 15.0 μm and is preferably from 4.0 μm to 12.0 μm.

The toner of the present invention may also be used in the form of a two-component developer by mixing with a magnetic carrier. The following can be used as the magnetic carrier: metal particles of, e.g., surface oxidized or nonoxidized iron, lithium, calcium, magnesium, nickel, copper, zinc, cobalt, manganese, chromium, and rare earths; alloy particles and oxide particles of the preceding; and magnetic carriers provided by the microparticulation of ferrite.

In developing methods in which an alternating-current bias is applied to the developing sleeve, the use is preferred of a coated carrier provided by coating the surface of a magnetic carrier core with a resin. The following coating methods may be used: methods in which a coating solution, prepared by dissolving or suspending a coating material such as a resin in a solvent, is applied to the surface of the magnetic carrier core; and methods in which a magnetic carrier core and a coating material are mixed as powders.

The coating material for the magnetic carrier core can be exemplified by silicone resins, polyester resins, styrenic resins, acrylic resins, polyamides, polyvinyl butyrals, and amino acrylate resins. A single one of these may be used or a plurality of these may be used. The amount of treatment with these coating materials, expressed with reference to the carrier core particle, is generally from 0.1 mass % to 30 mass % (preferably from 0.5 mass % to 20 mass %).

The average particle diameter of the magnetic carrier, expressed as the 50% particle diameter (D50) on a volume basis, is preferably from 10 μm to 100 μm and is more preferably from 20 μm to 70 μm. When a two-component developer is prepared, excellent results are obtained by having the mixing ratio therein, expressed as the toner concentration in the developer, be generally from 2 mass % to 15 mass % and preferably from 4 mass % to 13 mass %.

The methods for measuring the various property values are described below.

<The Molecular Weight Distribution of the Charge Control Resin>

The molecular weight and molecular weight distribution of the charge control resin are determined as polystyrene by gel permeation chromatography (GPC). When the molecular weight of an acid group-bearing resin is to be measured, the column elution rate will also depend on the amount of the acid group, and it is therefore necessary to prepare a sample in which the acid group has been capped in advance. Methyl esterification is preferred for this capping, and a commercially available methyl esterifying agent may be used. A specific example here is a method in which treatment with trimethylsilyldiazomethane is performed.

The measurement of the molecular weight by GPC is carried out as follows. First, the measurement sample is dissolved in tetrahydrofuran (THF) over 24 hours at room temperature. The resulting solution is filtered across a "MaeShoriDisk" (Tosoh Corporation) solvent-resistant membrane filter having a pore diameter of 0.2 μm to obtain the sample solution. The sample solution is adjusted to a concentration of the THF-soluble component of 0.8 mass %. Measurement is carried out under the following conditions using this sample solution.

instrument: HLC8120 GPC (detector: RI) (Tosoh Corporation)
columns: 7 column train of Shodex KF-801, 802, 803, 804, 805, 806, and 807 (Showa Denko KK)
eluent: tetrahydrofuran (THF)
flow rate: 1.0 mL/min
oven temperature: 40.0° C.
sample injection amount: 0.10 mL The molecular weight of the measurement sample is determined using a molecular weight calibration curve constructed using standard polystyrene resin (for example, product name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

<Method for Determining the Compositional Ratio in the Charge Control Resin>

For the compositional ratio in the charge control resin, the 2-acrylamido-2-methylpropanesulfonic acid-derived unit is determined by measurement of the amount of the element sulfur and the unit derived from an electron donor compound having a polymerizable unsaturated group is determined by NMR measurements.

[Measurement of the Content in the Charge Control Resin of the 2-acrylamido-2-methylpropanesulfonic Acid-Derived Unit]

The amount (ppm) of the element sulfur present in the polymer is measured and this amount of the element sulfur is used to calculate the content (μmol/g) of the 2-acrylamido-2-methylpropanesulfonic acid-derived unit in the charge control resin. Specifically, the resin is introduced into an automatic sample combustion instrument (instrument name: model AQF-100 Ion Chromatograph Pre-treatment Unit (instrument specifications: integrated model ABC Auto Boat Controller, AQF-100, and GA-100, from DIA Instruments Co., Ltd.)) and the resin is converted into a combustion gas and this gas is absorbed into an absorption solution ($H_2O_2$, 30 ppm aqueous solution). The amount of $SO_4$ in the absorption solution is then measured by ion chromatography (instrument name: ICS2000 Ion Chromatograph, column: IONPAC AS17, from Nippon Dionex Co., Ltd.) and this is used to calculate the amount (ppm) of the element sulfur in the resin. The content (μmol/g) of the 2-acrylamido-2-methylpropanesulfonic acid-derived unit is then calculated from the amount (ppm) of the element sulfur in the resin.

[Measurement of the Content in the Charge Control Resin of the Unit Derived from an Electron Donor Compound that has a Polymerizable Unsaturated Group]

The content in the charge control resin of the unit derived from an electron donor compound that has a polymerizable unsaturated group is determined using a nuclear magnetic resonance instrument ($^1$H-NMR).

The instrument used is described below.

$^1$H-NMR
measurement instrumentation: JNM-EX400 FT-NMR instrument (JEOL Ltd.)
measurement frequency: 400 MHz
pulse condition: 5.0 μs
frequency range: 10,500 Hz
number of integrations: 64
measurement temperature: 30° C.

50 mg of the sample is introduced into a sample tube having an internal diameter of 5 mm and deuterochloroform ($CDCl_3$) is added as solvent and dissolution is carried out in a 40° C. thermostat to produce the measurement sample. Measurement under the conditions described above was carried out using this measurement sample.

<Measurement of the Acid Value of the Resin>

The acid value is the number of milligrams of potassium hydroxide required to neutralize the acid present in 1 g of a sample. The acid value in the present invention is measured based on JIS K 0070-1992, and in specific terms the measurement is carried out as follows.

The titration is run using a 0.1 mol/L ethanolic potassium hydroxide solution (Kishida Chemical Co., Ltd.). The factor for this ethanolic potassium hydroxide solution can be determined using a potentiometric titration apparatus (the AT-510 potentiometric titrator from Kyoto Electronics Manufacturing Co., Ltd.). 100 mL of 0.100 mol/L hydrochloric acid is introduced into a 250-mL tall beaker and is titrated with the aforementioned ethanolic potassium hydroxide solution and the factor is determined from the amount of the ethanolic potassium hydroxide solution required for neutralization. The 0.100 mol/L hydrochloric acid used is prepared based on JIS K 8001-1998.

The measurement conditions during measurement of the acid value are given below.

titration instrument: AT-510 potentiometric titration apparatus (Kyoto Electronics Manufacturing Co., Ltd.)

electrode: composite glass electrode, double junction type (Kyoto Electronics Manufacturing Co., Ltd.)

titrator control software: AT-WIN titration analysis software: Tview

The titration is carried out using the following titration parameters and control parameters.

Titration Parameters titration mode: blank titration titration form: full titration maximum titration volume: 20 mL wait time before titration: 30 seconds titration direction: automatic Control Parameters endpoint sense potential: 30 dE endpoint sense potential value: 50 dE/dmL endpoint detection sensing: not set control speed mode: standard gain: 1 data sampling potential: 4 mV data sampling volume: 0.1 mL

Main Test:

0.100 g of the measurement sample is accurately weighed into a 250-mL tall beaker and 150 mL of a toluene/ethanol (3:1) mixed solution is added and dissolution is carried out over 1 hour. Titration is performed using the above-indicated potentiometric titration apparatus and the above-indicated ethanolic potassium hydroxide solution.

Blank Test:

The same titration as in the above procedure is run, but without using the sample (that is, with only the toluene/ethanol (3:1) mixed solution).

The results are substituted into the following equation and the acid value is calculated.

$$A=[(C-B)\times f\times 5.61]/S$$

(in the equation, A: acid value (mg KOH/g), B: amount (mL) of addition of the potassium hydroxide solution in the blank test, C: amount (mL) of addition of the potassium hydroxide solution in the main test, f: factor for the potassium hydroxide solution, S: sample (g)).

<Structural Analysis of the Charge Control Resin>

The structural determination of the charge control resin can be performed using a nuclear magnetic resonance instrument ($^{1}$H-NMR, $^{13}$C-NMR) and an FT-IR spectrometer. The instrumentation used is described below.

(i) The Nuclear Magnetic Resonance Instrument

JNM-EX400 FT-NMR from JEOL Ltd. (solvent used: deuterochloroform)

(ii) The FT-IR Spectrometer

AVATAR 360 FT-IR from Thermo Fisher Scientific Inc.

<The Glass Transition Temperature of the Charge Control Resin and Toner>

The glass transition temperature of the toner of the present invention is measured using a differential scanning calorimeter (DSC measurement instrument).

The measurement is run as follows based on ASTM D 3418-82 using a "Q1000" differential scanning calorimeter (TA Instruments) for the differential scanning calorimeter. A 3 mg measurement sample is weighed out. This is introduced into an aluminum pan, and an empty aluminum pan is used for reference. After equilibration for 5 minutes at 20° C., the measurement is run at a ramp rate of 1° C./min in the measurement range between 20 and 140° C. while applying a modulation of 1.0° C./min. The glass transition temperature is determined by the midpoint method in present invention.

<The Weight-Average Particle Diameter (D4) and Number-Average Particle Diameter (D1) of the Toner>

The weight-average particle diameter (D4) and the number-average particle diameter (D1) of the toner are determined as follows. The measurement instrument used is a "Coulter Counter Multisizer 3" (registered trademark, from Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25,000 channels for the number of effective measurement channels.

The aqueous electrolyte solution used for the measurements is prepared by dissolving special-grade sodium chloride in ion-exchanged water to provide a concentration of 1 mass % and, for example, "ISOTON II" (from Beckman Coulter, Inc.) can be used.

The dedicated software is configured as follows prior to measurement and analysis. In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush". In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) 30 mL of the above-described aqueous electrolyte solution is introduced into a 100-mL flatbottom glass beaker. To this is added as dispersing agent 0.3 mL of a dilution prepared by the three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of ion-exchanged water is introduced into the water tank of this ultrasound disperser and 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the round-bottom beaker set in the sample stand as described in (1) with adjustment to provide a measurement concentration of 5%. Measurement is then performed until the number of measured particles reaches 50,000.

(7) The measurement data is analyzed by the previously cited dedicated software provided with the instrument and the weight-average particle diameter (D4), the number-average particle diameter (D1), the volume-based median diameter, and the number-based median diameter are calculated. When set to graph/volume % with the dedicated software, the "average diameter" on the "analysis/volumetric statistical value (arithmetic average)" screen is the weight-average particle diameter (D4) and the "median diameter" is the volume-based median diameter (Dv50). When set to graph/number % with the dedicated software, the "average diameter" on the "analysis/numerical statistical value (arithmetic average)" screen is the number-average particle diameter (D1) and the "median diameter" is the number-based median diameter (Dn50).

EXAMPLES

The present invention is specifically described through the examples provided below, but the present invention is not limited to or by these examples. "Parts" means "mass parts".

Production Example for Charge Control Resin 1

A reactor equipped with a stirrer, condenser, thermometer, and nitrogen introduction tube was prepared. The reactor was placed in a state that was not shielded from light and 100.0 parts of 2-butanone and 50.0 parts of methanol were introduced and the reactor was brought to 60° C. under a nitrogen current.

The following monomers and solvents were then mixed to prepare monomer mixtures.

<Monomer Composition and Mixing Proportions>

The 2-acrylamido-2-methylpropanesulfonic acid-containing mixture

| | |
|---|---|
| 2-acrylamido-2-methylpropanesulfonic acid | 6.1 parts |
| styrene | 83.0 parts |
| 2-ethylhexyl acrylate | 9.0 parts |
| 2-butanone | 100.0 parts |
| methanol | 50.0 parts |
| dimethyl 2,2'-azobis(2-methylpropionate) | 1.0 parts |
| The 4-vinylpyridine-containing mixture | |
| 4-vinylpyridine | 1.9 parts |
| 2-butanone | 50.0 parts |

Each of these mixed solutions was added dropwise to the reactor over 60 minutes by different routes. Stirring was carried out for 8 hours at 60° C. followed by cooling to room temperature.

The resulting polymer-containing composition was dripped into 1400 parts of methanol to bring about precipitation and crystallization of the resin component. The obtained resin component was filtered and was washed twice with 200 parts of methanol.

The obtained resin powder was dried for 10 hours at 60° C. under reduced pressure to obtain a charge control resin 1.

<Production Examples for Charge Control Resins 2 to 10>

Charge control resins 2 to 10 were obtained by the same method as in the Production Example for Charge Control Resin 1, but changing the monomer composition and mixing proportions and the number of parts of the polymerization initiator to that given in Table 1. The compositional ratios and molecular weights are given in Table 2.

In Tables 1 and 2, AMPS indicates 2-acrylamido-2-methylpropanesulfonic acid; 4-VP indicates 4-vinylpyridine; 2-EHA indicates 2-ethylhexyl acrylate; and electron donor compound indicates the electron donor compound that has a polymerizable unsaturated group.

In addition, the A/B mol ratio in Tables 2 and 3 represents (mol % in the charge control resin of the 2-acrylamido-2-methylpropanesulfonic acid-derived unit/mol % in the charge control resin of the unit derived from an electron donor compound having a polymerizable unsaturated group).

TABLE 1

| | | AMPS | electron donor compound | | vinylic monomer 1 | | vinylic monomer 2 | | dimethyl 2,2'-azobis(2- |
|---|---|---|---|---|---|---|---|---|---|
| production example | charge control resin | amount charged (parts) | compound | amount charged (parts) | structure | amount charged (parts) | structure | amount charged (parts) | methylpropionate) amount charged (parts) |
| production example 1 | charge control resin 1 | 6.1 | 4-VP | 1.9 | styrene | 83.0 | 2-EHA | 9.0 | 1 |

TABLE 1-continued

| production example | charge control resin | AMPS amount charged (parts) | electron donor compound compound | electron donor compound amount charged (parts) | vinylic monomer 1 structure | vinylic monomer 1 amount charged (parts) | vinylic monomer 2 structure | vinylic monomer 2 amount charged (parts) | dimethyl 2,2'-azobis(2-methylpropionate) amount charged (parts) |
|---|---|---|---|---|---|---|---|---|---|
| production example 2 | charge control resin 2 | 6.1 | 4-VP | 1.0 | styrene | 83.8 | 2-EHA | 9.1 | 1.25 |
| production example 3 | charge control resin 3 | 6.1 | 4-VP | 2.4 | styrene | 82.5 | 2-EHA | 9.1 | 0.8 |
| production example 4 | charge control resin 4 | 6.1 | 4-VP | 1.9 | styrene | 83.0 | 2-EHA | 9.0 | 2 |
| production example 5 | charge control resin 5 | 6.1 | 4-VP | 1.9 | styrene | 83.0 | 2-EHA | 9.0 | 0.6 |
| production example 6 | charge control resin 6 | 7.3 | 4-VP | 0.4 | styrene | 83.3 | 2-EHA | 9.0 | 1 |
| production example 7 | charge control resin 7 | 6.1 | 4-VP | 3.1 | styrene | 81.8 | 2-EHA | 9.0 | 1 |
| production example 8 | charge control resin 8 | 7.3 | none | — | styrene | 83.7 | 2-EHA | 9.0 | 1.25 |
| production example 9 | charge control resin 9 | 6.1 | 4-VP | 5.6 | styrene | 79.2 | 2-EHA | 9.1 | 1 |
| production example 10 | charge control resin 10 | 7.3 | 4-VP | 0.2 | styrene | 83.5 | 2-EHA | 9.0 | 1 |

TABLE 2

| production example | charge control resin | AMPS-derived unit mol % | electron donor compound-derived unit compound | electron donor compound-derived unit mol % | A/B mol ratio | weight-average molecular weight (Mw) | Mw/Mn | Tg (° C.) |
|---|---|---|---|---|---|---|---|---|
| production example 1 | charge control resin 1 | 3.3 | 4-VP | 2.0 | 1.7 | 31000 | 2.2 | 79 |
| production example 2 | charge control resin 2 | 3.3 | 4-VP | 1.1 | 3.0 | 15000 | 2.1 | 77 |
| production example 3 | charge control resin 3 | 3.3 | 4-VP | 2.5 | 1.3 | 52100 | 2.7 | 83 |
| production example 4 | charge control resin 4 | 3.3 | 4-VP | 2.0 | 1.7 | 3500 | 2.0 | 65 |
| production example 5 | charge control resin 5 | 3.3 | 4-VP | 2.0 | 1.7 | 98000 | 2.8 | 86 |
| production example 6 | charge control resin 6 | 4.0 | 4-VP | 0.4 | 10.0 | 32500 | 2.2 | 81 |
| production example 7 | charge control resin 7 | 3.3 | 4-VP | 3.3 | 1.0 | 29500 | 2.1 | 78 |
| production example 8 | charge control resin 8 | 4.0 | none | 0 | — | 14500 | 2.0 | 76 |
| production example 9 | charge control resin 9 | 3.3 | 4-VP | 6.0 | 0.6 | 29500 | 2.2 | 82 |
| production example 10 | charge control resin 10 | 4.0 | 4-VP | 0.2 | 20.0 | 33200 | 2.3 | 82 |

Example 1

Toner Production Example

Preparation of a Pigment Dispersion Paste

<Charge Proportions>

| | |
|---|---|
| styrene | 80.0 parts |
| C.I. Pigment Blue 15:3 | 14.0 parts |

After these materials had been thoroughly premixed in a container, they were dispersed for 5 hours in a bead mill while keeping at 20° C. or below to produce a pigment dispersion paste.

Toner Particle Production 390 parts of a 0.1 mol/L aqueous $Na_3PO_4$ solution was introduced into 1150 parts of ion-exchanged water and, after heating to 60° C., stirring was carried out at 11,000 rpm using a CLEARMIX (M Technique Co., Ltd.). To this was added 58 parts of a 1.0 mol/L aqueous $CaCl_2$ solution to obtain a dispersion containing $Ca_3(PO_4)_2$.

<Charge Proportions>

| | |
|---|---|
| the pigment dispersion paste described above | 38.0 parts |
| styrene | 34.0 parts |
| n-butyl acrylate | 15.0 parts |
| paraffin wax (HNP-9: Nippon Seiro Co., Ltd.) | 8.00 parts |
| saturated polyester resin (terephthalic acid-propylene oxide-modified bisphenol A copolymer, acid value = 11 mg KOH/g, Mw: 14,700) | 5.00 parts |
| charge control resin 1 | 0.500 parts |

These were heated to 60° C. and melted and dispersed to make a monomer mixture. While holding at 60° C., 5.00 parts of the polymerization initiator 2,2'-azobis(2,4-dimethylvaleronitrile) was added with dissolution to produce a monomer composition.

This monomer composition was introduced into the above-described dispersion medium. The monomer composition was granulated by stirring at 60° C. in a nitrogen atmosphere for 20 minutes at 10,000 rpm using a CLEARMIX. This was followed by reacting for 5 hours at 60° C. while stirring with a paddle stirring blade and then completion of the polymerization by stirring for 5 hours at 80° C. After cooling to room temperature, the $Ca_3(PO_4)_2$ was dissolved by the addition of hydrochloric acid followed by filtration, washing with water, and drying to obtain toner particles. Classification was performed on the obtained toner particles to select particles equal to and greater than 2 μm but less than 10 μm, thereby producing toner particle 1.

Toner Production

Using a Henschel mixer (Mitsui Miike Chemical Engineering Machinery Co., Ltd.), toner 1 was obtained by the mixing and external addition, into 100 parts of the obtained toner particle 1, of 1 part of a hydrophobic silica fine powder that had a primary particle number-average particle diameter of 9 nm and a BET specific surface area of 180 $m^2/g$ and that had been subjected to a surface treatment with hexamethyldisilazane followed by treatment with a silicone oil.

Example 2

A toner 2 was obtained by production as in Example 1, but changing the charge control resin 1 in Example 1 to charge control resin 2.

Example 3

A toner 3 was obtained by production as in Example 1, but changing the charge control resin 1 in Example 1 to charge control resin 3.

Example 4

Preparation of a Pigment Dispersion Paste

<Charge Proportions>

| | |
|---|---|
| styrene | 80.0 parts |
| carbon black | 14.0 parts |

After these materials had been thoroughly premixed in a container, they were dispersed for 4 hours in a bead mill while keeping at 20° C. or below to produce a pigment dispersion paste.

Toner Particle Production 350 parts of a 0.1 mol/L aqueous $Na_3PO_4$ solution was introduced into 1200 parts of ion-exchanged water and, after heating to 60° C., stirring was carried out at 11,000 rpm using a CLEARMIX (M Technique Co., Ltd.). To this was added 52 parts of a 1.0 mol/L aqueous $CaCl_2$ solution to obtain a dispersion medium containing $Ca_3(PO_4)_2$.

| | |
|---|---|
| the pigment dispersion paste described above | 38.0 parts |
| styrene | 30.0 parts |
| n-butyl acrylate | 17.0 parts |
| ester wax (major component = $C_{19}H_{39}COOC_{20}H_{41}$, melting point = 68.6° C.) | 10.0 parts |

-continued

| | |
|---|---|
| saturated polyester resin (terephthalic acid-propylene oxide-modified bisphenol A copolymer, acid value = 11 mg KOH/g, Mw: 14,700) | 5.00 parts |
| charge control resin 1 | 0.500 parts |

These were heated to 60° C. and dissolved and dispersed to make a monomer mixture. While holding at 60° C., 5.00 parts of the polymerization initiator 2,2'-azobis(2,4-dimethylvaleronitrile) was also added with dissolution to provide a monomer composition.

This monomer composition was introduced into the above-described dispersion medium. The monomer composition was granulated by stirring at 60° C. in a nitrogen atmosphere for 20 minutes at 10,000 rpm using a CLEARMIX. This was followed by reacting for 5 hours at 60° C. while stirring with a paddle stirring blade and then completion of the polymerization by stirring for 5 hours at 80° C. After cooling to room temperature, the $Ca_3(PO_4)_2$ was dissolved by the addition of hydrochloric acid followed by filtration, washing with water, and drying to obtain toner particles. As in the production example for toner 1, classification was performed to obtain toner particle 4, and toner 4 was then obtained by the external addition of the hydrophobic silica fine powder to toner particle 4.

Example 5

A toner 5 was obtained by production as in Example 1, but changing the C. I. Pigment Blue 15:3 colorant used in Example 1 to quinacridone (C. I. Pigment Violet 19) and using 14.0 parts for its parts of addition.

Example 6

A toner 6 was obtained by production as in Example 1, but changing the charge control resin 1 in Example 1 to charge control resin 4.

Example 7

A toner 7 was obtained by production as in Example 1, but changing the charge control resin 1 in Example 1 to charge control resin 5.

Example 8

A toner 8 was obtained by production as in Example 1, but changing the charge control resin 1 in Example 1 to charge control resin 6.

Example 9

A toner 9 was obtained by production as in Example 1, but changing the charge control resin 1 in Example 1 to charge control resin 7.

Example 10

Polyester Resin Production:

| | |
|---|---|
| bisphenol A/2.2 mol propylene oxide adduct | 1190.0 parts |
| bisphenol A/2.2 mol ethylene oxide adduct | 485.0 parts |
| terephthalic acid | 250.0 parts |
| trimellitic anhydride | 190.0 parts |

-continued

| | |
|---|---|
| fumaric acid | 290.0 parts |
| dibutyltin oxide | 0.1 parts |
| were introduced into a 4-liter four-neck glass flask, which was fitted with a thermometer, stirring rod, condenser, and nitrogen introduction tube and was placed in a heating mantle. A polyester resin was obtained by a reaction for 5 hours at 220° C. under a nitrogen atmosphere. | |
| the obtained polyester resin | 89.5 parts |
| C.I. Pigment Blue 15:3 | 5.50 parts |
| paraffin wax (HNP-9: Nippon Seiro Co., Ltd.) | 5.00 parts |
| charge control resin 1 | 0.500 parts |

These toner materials were thoroughly premixed in a Henschel mixer (Mitsui Miike Chemical Engineering Machinery Co., Ltd.) followed by melt kneading with a twin-screw extruder, cooling, and then coarse pulverization to a particle diameter of approximately 1 to 2 mm using a hammer mill. Fine pulverization was subsequently carried out using an air jet-based pulverizer. The resulting finely pulverized material was classified using a multigrade classifier to obtain a toner particle 10. Proceeding as in the production example for toner 1, a toner 10 was obtained by the external addition of the hydrophobic silica fine powder to the toner particle 10.

Comparative Example 1

A toner 11 was obtained by production as in Example 1, but changing the charge control resin 1 in Example 1 to charge control resin 8.

Comparative Example 2

A toner 12 was obtained by production as in Example 1, but changing the charge control resin 1 in Example 1 to charge control resin 9.

Comparative Example 3

A toner 13 was obtained by production as in Example 1, but changing the charge control resin 1 in Example 1 to charge control resin 10.

Comparative Example 4

A toner 14 was obtained by production as in Example 1, but in this case without adding the charge control resin 1 used in Example 1.

The properties of the thusly obtained toners are given in Table 3.

TABLE 3

| | toner | charge control resin | A/B mol ratio | weight-average molecular weight of the charge control resin | Tg (° C.) | toner particle diameter (D4) (μm) | toner production method |
|---|---|---|---|---|---|---|---|
| Example 1 | toner 1 | charge control resin 1 | 1.7 | 31000 | 58.3 | 6.8 | suspension polymerization |
| Example 2 | toner 2 | charge control resin 2 | 3.0 | 15000 | 58.1 | 6.7 | suspension polymerization |
| Example 3 | toner 3 | charge control resin 3 | 1.3 | 52100 | 58.1 | 6.6 | suspension polymerization |
| Example 4 | toner 4 | charge control resin 1 | 1.7 | 31000 | 58.2 | 6.8 | suspension polymerization |
| Example 5 | toner 5 | charge control resin 1 | 1.7 | 31000 | 58.3 | 6.7 | suspension polymerization |
| Example 6 | toner 6 | charge control resin 4 | 1.7 | 3500 | 57.6 | 6.6 | suspension polymerization |
| Example 7 | toner 7 | charge control resin 5 | 1.7 | 98000 | 58.8 | 6.7 | suspension polymerization |
| Example 8 | toner 8 | charge control resin 6 | 10.0 | 32500 | 58.5 | 6.4 | suspension polymerization |
| Example 9 | toner 9 | charge control resin 7 | 1.0 | 29500 | 58.0 | 6.5 | suspension polymerization |
| Example 10 | toner 10 | charge control resin 1 | 1.7 | 31000 | 58.1 | 6.8 | pulverization |
| Comparative Example 1 | toner 11 | charge control resin 8 | ∞ | 14500 | 58.0 | 6.6 | suspension polymerization |
| Comparative Example 2 | toner 12 | charge control resin 9 | 0.6 | 29500 | 58.2 | 6.7 | suspension polymerization |
| Comparative Example 3 | toner 13 | charge control resin 10 | 20.0 | 33200 | 58.1 | 6.7 | suspension polymerization |
| Comparative Example 4 | toner 14 | none | none | — | 58.1 | 6.6 | suspension polymerization |

The triboelectric charge quantity for the toner of the present invention can be determined by the following method. The evaluation was carried out on the two-component developer provided by mixing the toner and a standard carrier for negative charging toner (product name: N-01, from The Imaging Society of Japan) so as to provide a toner concentration of 4%. The standard carrier for negative charging toner (product name: N-01, from The Imaging Society of Japan) used in these measurements was the material that had passed through 250 mesh.

In order to facilitate a comparison of the effects of the present invention, the evaluations were performed using a low toner concentration in the two-component developer for the present invention and generating a large absolute value for the triboelectric charge quantity on the toner.

The following evaluations were carried out on these toners and two-component developers.

1) Evaluation of the Environmental Dependence:

50 g of the two-component developer was divided out and held in a normal-temperature, normal-humidity environment (23° C./60% RH) for 4 days or in a high-temperature, high-humidity environment (30° C./80% RH) environment for 4 days. After this, the two-component developer was placed in a 50-cc plastic container and was shaken 300 times over 2 minutes and was then measured using the apparatus in FIG. 1. For the evaluation, the absolute value of the triboelectric charge quantity was measured for each shaking episode and ranking according to the following criteria was carried out. The results are given in Table 4.

environmental dependence evaluation=triboelectric charge quantity for the high-temperature, high-humidity environment/triboelectric charge quantity for the normal-temperature, normal-humidity environment A rank: at least 1.00 but less than 1.20
B rank: at least 1.20 but less than 1.30
C rank: at least 1.30 but less than 1.40
D rank: at least 1.40

(Method for Measuring the Quantity of Charge)

0.5 g of the two-component developer submitted for measurement of the triboelectric charge quantity is introduced into a metal measurement container 2 having a 500-mesh (aperture=25 μm) screen 3 at the bottom and a metal cap 4 is applied. The mass of the entire measurement container 2 at this point is weighed and designated W1 (g). Then, with the suction apparatus 1 (at least the part in contact with the measurement container 2 is an insulator), suction is carried out through a suction port 7 and the pressure on the vacuum gauge 5 is brought to 250 mmAq by adjusting the air quantity control valve 6. Thorough suctioning, preferably for 2 minutes, is carried out in this state to suction off the toner. The potential on the electrometer 9 at this time is designated V (in volts). Here, 8 refers to a capacitor, and its capacity is designated C (μF). The mass of the entire measurement container is then measured post-suction and designated W2 (g). The triboelectric charge quantity (mC/kg) of the toner is calculated using the following formula.

$$\text{triboelectric charge quantity (mC/kg)}=(C\times V)/(W1-W2)$$

It is shown as a result that the toners of Examples 1 to 10 according to the present invention have an environmental dependence superior to that of the toners of Comparative Examples 1 to 4.

Image output evaluations were then carried out as follows on the toners of Examples 1 to 10 and Comparative Examples 1 to 4.

Figure 2:
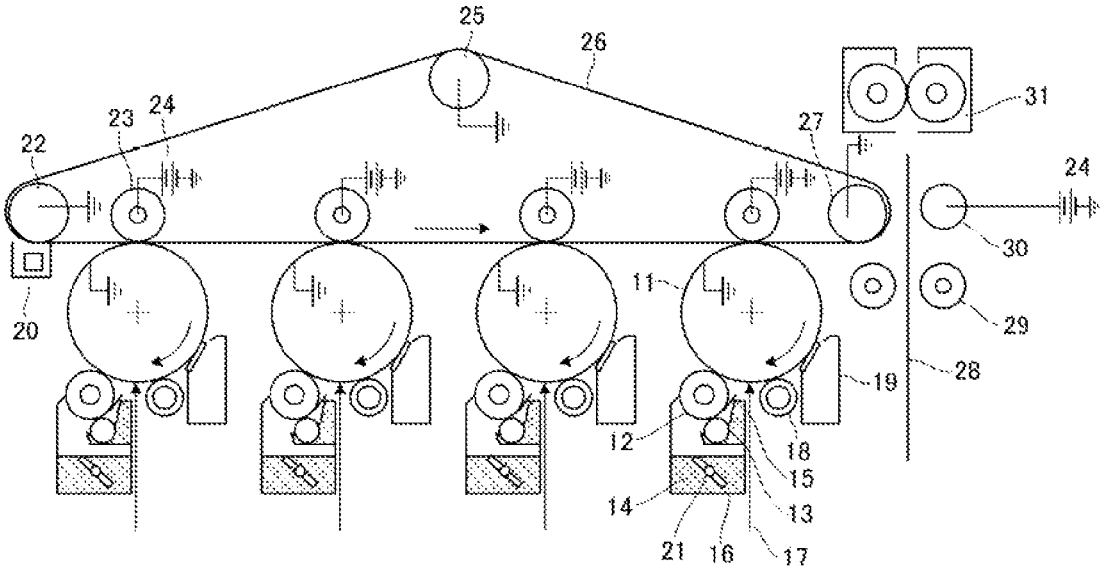
FIG. 2 is a schematic structural diagram that shows an example of a process cartridge and image-forming apparatus that are used by the present invention.

2) Image Output Evaluations:

130 g of toner 1 was filled into a toner cartridge for an LBP9600C tandem-mode laser printer from Canon, Inc. having the structure shown in FIG. 2. Holding was then carried out for 72 hours in a normal-temperature, normal-humidity environment (23° C./60% RH) or a high-temperature, high-humidity environment (30° C./85% RH).

In FIG. 2, 11 designates a photosensitive member; 12 designates a developing roller; 13 designates a toner feed roller; 14 designates a toner; 15 designates a regulating blade; 16 designates a developing assembly; 17 designates laser light; 18 designates a charging device; 19 designates a cleaning apparatus; 20 designates a charging device for cleaning; 21 designates a stirring paddle; 22 designates a driver roller; 23 designates a transfer roller; 24 designates a bias power source; 25 designates a tension roller; 26 designates a transfer transport belt; 27 designates a driven roller; 28 designates paper; 29 designates a paper feed roller; 30 designates an attraction roller; and 31 designates a fixing apparatus.

For the evaluation, the toner cartridge filled as described above was loaded in the cyan station and dummy cartridges were loaded elsewhere and image evaluations were performed in the normal-temperature, normal-humidity environment and in the high-temperature, high-humidity environment. In the image-output tests, designating the 1st to the 5th print as the initial interval 1, the 95th to the 100th print as the initial interval 2, and the 9995th to the 10,000th print as post-durability testing, the image density and fogging were measured and their average values were determined. 75 g/m$^2$ A4 plain paper was used in these tests, and an original chart with an image area percentage of 1% was continuously output. The results are given in Table 4.

<Evaluation of the Image Density>

The image density was evaluated using a MacBeth densitometer (RD-914, MacBeth Corporation) fitted with an SPI auxiliary filter. The image density of the fixed image region of the output image was measured, and an evaluation was made using the following criteria from the relative density with reference to the printed-out image of the white background region having an image density of 0.00.

A rank: at least 1.40

B rank: at least 1.30 but less than 1.40

C rank: at least 1.20 but less than 1.30

D rank: at least 1.10 but less than 1.20

E rank: less than 1.10

<Evaluation of the Fogging>

The fogging density (%) was calculated from the difference between the brightness of the white background region of the printed-out image and the brightness of the transfer paper, as measured with a "Reflectometer" (Tokyo Denshoku Co., Ltd.), and the image fogging was evaluated using the following criteria.

A rank: not more than 0.5%

B rank: more than 0.5% but not more than 1.0%

C rank: more than 1.0% but not more than 1.5%

D rank: more than 1.5% but not more than 2.5%

E rank: more than 2.5%

TABLE 4

| | | evaluation of environmental dependence | | | | image output evaluation normal temperature and normal humidity | | | | | | | | | |
|---|---|---|---|---|---|---|---|---|---|---|---|---|---|---|---|
| | | | | | | image density | | | | | | fogging (%) | | | |
| | toner | quantity of charge at normal temperature and normal humidity (mC/kg) | quantity of charge at high temperature and high humidity (mC/kg) | environmental dependence (mC/kg) | | initial interval 1 | | initial interval 2 | | post-durability testing | | initial interval 1 | | initial interval 2 | |
| Example 1 | toner 1 | −84.5 | −74.5 | 1.13 | A | 1.43 | A | 1.46 | A | 1.45 | A | 0.3 | A | 0.4 | A |
| Example 2 | toner 2 | −83.2 | −71.5 | 1.16 | A | 1.42 | A | 1.45 | A | 1.44 | A | 0.4 | A | 0.3 | A |
| Example 3 | toner 3 | −76.5 | −64.1 | 1.19 | A | 1.42 | A | 1.42 | A | 1.42 | A | 0.4 | A | 0.4 | A |
| Example 4 | toner 4 | −81.4 | −71.5 | 1.14 | A | 1.44 | A | 1.45 | A | 1.44 | A | 0.4 | A | 0.4 | A |
| Example 5 | toner 5 | −80.5 | −71.1 | 1.13 | A | 1.43 | A | 1.45 | A | 1.44 | A | 0.4 | A | 0.3 | A |
| Example 6 | toner 6 | −76.1 | −60.7 | 1.25 | B | 1.41 | A | 1.43 | A | 1.42 | A | 0.5 | A | 0.4 | A |
| Example 7 | toner 7 | −68.5 | −53.4 | 1.28 | B | 1.39 | B | 1.41 | A | 1.40 | A | 0.7 | B | 0.6 | B |
| Example 8 | toner 8 | −83.1 | −63.5 | 1.31 | C | 1.38 | B | 1.42 | A | 1.41 | A | 0.8 | B | 0.7 | B |
| Example 9 | toner 9 | −65.0 | −49.5 | 1.31 | C | 1.37 | B | 1.40 | A | 1.38 | B | 1.2 | C | 1.0 | C |
| Example 10 | toner 10 | −81.5 | −60.5 | 1.35 | C | 1.39 | B | 1.41 | A | 1.40 | A | 0.9 | B | 0.6 | B |
| Comparative Example 1 | toner 11 | −78.5 | −41.5 | 1.89 | D | 1.25 | C | 1.35 | B | 1.33 | B | 1.7 | D | 1.2 | C |
| Comparative Example 2 | toner 12 | −39.5 | −18.8 | 2.10 | D | 1.18 | D | 1.21 | C | 1.17 | D | 1.5 | C | 1.1 | C |
| Comparative Example 3 | toner 13 | −80.6 | −48.5 | 1.66 | D | 1.28 | C | 1.36 | B | 1.37 | B | 1.6 | D | 1.2 | C |
| Comparative Example 4 | toner 14 | −33.5 | −16.5 | 2.03 | D | 1.08 | E | 1.20 | C | 1.11 | D | 3.1 | E | 2.7 | E |

| | image output evaluation | | | | | | | | | | | | | | | |
|---|---|---|---|---|---|---|---|---|---|---|---|---|---|---|---|---|
| | normal temperature and normal humidity | | | | high temperature and high humidity | | | | | | | | | | | |
| | fogging (%) | | | | image density | | | | | | fogging (%) | | | | | |
| | post-durability testing | | initial interval 1 | | initial interval 2 | | post-durability testing | | initial interval 1 | | initial interval 2 | | post-durability testing | |
| Example 1 | 0.3 | A | 1.41 | A | 1.44 | A | 1.42 | A | 0.4 | A | 0.4 | A | 0.4 | A |
| Example 2 | 0.3 | A | 1.42 | A | 1.44 | A | 1.43 | A | 0.5 | A | 0.4 | A | 0.4 | A |
| Example 3 | 0.4 | A | 1.41 | A | 1.42 | A | 1.41 | A | 0.5 | A | 0.5 | A | 0.5 | A |
| Example 4 | 0.4 | A | 1.43 | A | 1.45 | A | 1.43 | A | 0.5 | A | 0.5 | A | 0.5 | A |
| Example 5 | 0.4 | A | 1.42 | A | 1.43 | A | 1.42 | A | 0.5 | A | 0.4 | A | 0.4 | A |
| Example 6 | 0.6 | B | 1.37 | B | 1.40 | A | 1.39 | B | 0.8 | B | 0.6 | B | 0.8 | B |
| Example 7 | 0.7 | B | 1.34 | B | 1.38 | B | 1.37 | B | 0.9 | B | 0.7 | B | 0.9 | B |
| Example 8 | 0.9 | B | 1.32 | B | 1.38 | B | 1.37 | B | 1.2 | C | 0.8 | B | 1.3 | C |
| Example 9 | 1.3 | C | 1.31 | B | 1.36 | B | 1.35 | B | 1.4 | C | 1.2 | C | 1.4 | C |
| Example 10 | 0.7 | B | 1.35 | B | 1.38 | B | 1.37 | B | 1.2 | C | 0.8 | B | 0.9 | B |
| Comparative Example 1 | 1.9 | D | 1.16 | D | 1.25 | C | 1.27 | C | 2.0 | D | 1.7 | D | 2.4 | D |
| Comparative Example 2 | 1.6 | D | 1.08 | E | 1.16 | D | 1.10 | D | 2.0 | D | 1.7 | D | 2.6 | E |
| Comparative Example 3 | 1.8 | D | 1.18 | D | 1.29 | C | 1.28 | C | 1.9 | D | 1.6 | D | 2.3 | D |
| Comparative Example 4 | 3.7 | E | 1.02 | E | 1.07 | E | 1.04 | E | 3.6 | E | 2.9 | E | 4.2 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-032784, filed Feb. 24, 2014, which is hereby incorporated by reference herein in its entirety.

What is claimed is:

1. A toner comprising a toner particle that contains a binder resin and a charge control resin, wherein the charge control resin is a polymer that contains a unit A and a unit B, the unit A is a unit derived from 2-acrylamido-2-methylpropanesulfonic acid, the unit B is a unit derived from an electron donor compound that has a polymerizable unsaturated group, and a molar ratio between the unit A and the unit B in the charge control resin (mol % of unit A/mol % of unit B) is from 1.0 to 10.0.

2. The toner according to claim 1, wherein the electron donor compound that has a polymerizable unsaturated group is a vinylpyridine.

3. The toner according to claim 1, wherein a weight-average molecular weight (Mw) of the charge control resin is from 2,500 to 100,000.

4. The toner according to claim 1, wherein the toner particle is produced by a method containing following steps of:

a dispersing step for dispersing, in an aqueous medium, a polymerizable monomer composition that contains a polymerizable monomer and a charge control resin, a granulating step for producing particles of the polymerizable monomer composition, and a polymerizing step for polymerizing the polymerizable monomer present in the particles produced by the granulation.

* * * * *